United States Patent [19]

Wilcox

[11] Patent Number: 4,805,757

[45] Date of Patent: Feb. 21, 1989

[54] ESCALATOR STEP SIDE PLATE

[76] Inventor: John R. Wilcox, 7534 Ivory La., Rockford, Ill. 61108

[21] Appl. No.: 947,943

[22] Filed: Dec. 31, 1986

[51] Int. Cl.[4] ..... B66B 23/12

[52] U.S. Cl. ..... 198/333

[58] Field of Search ..... 198/333, 326, 323, 853, 198/713, 714

[56] References Cited

U.S. PATENT DOCUMENTS

| | | | |
|---|---|---|---|
| 4,159,763 | 7/1979 | Kewley et al. | 198/853 |
| 4,413,719 | 11/1983 | White | 198/333 |
| 4,569,433 | 2/1986 | Ishida et al. | 198/333 |
| 4,618,056 | 10/1986 | Cutshall | 198/853 |
| 4,638,901 | 1/1987 | Lunardi | 198/333 X |

FOREIGN PATENT DOCUMENTS

| | | | |
|---|---|---|---|
| 18685 | 2/1977 | Japan | 198/333 |

*Primary Examiner*—Robert J. Spar
*Assistant Examiner*—Cheryl L. Gastineau
*Attorney, Agent, or Firm*—Anthony A. O'Brien

[57] ABSTRACT

An escalator step includes a side plate co-extensive with and flushly affixed to each side wall of the step and presents a planar outer face adapted to travel juxtaposed the planar inner surface of escalator skirt panels. Tie rods retain each pair of side plates on a step and include end portions fully disposed within counterbores formed in the side plates whereupon friction-attached fasteners maintain the side panels inwardly against the respective step side walls.

1 Claim, 1 Drawing Sheet

1
2
3
4
5
6
8
9
10
11'
14
21
S 1
3
4
5
6
7
9
10
11
11'
12
14
15
16
17
18
19
20
21
22
23
S

ESCALATOR STEP SIDE PLATE

BACKGROUND OF THE INVENTION

As is well know to those skilled in this art, an escalator comprises a plurality of steps which are progressively guided between a pair of spaced-apart skirt panels. Numerous efforts have been made to provide either a suitable interface between the lateral faces of the steps and the juxtaposed skirt panels or alternatively, to provide an appropriate resilient mask or sliding seal between these two relatively moving components. The objective of such construction should be obvious. On the one hand, safety must be considered to preclude pinching, catching or insertion of a users foot or clothing in the area between the constantly moving steps and the stationary skirt panel, while on the other hand, a mechanically clean interface must be maintained with a minimum of friction between the moving parts with provision for discouraging entry of dirt and other foreign particles there-between.

A solution to the above problem is to provide for the attachment, to each side of the steps, of removable members serving to offer a low-friction interface between the lateral portions of the steps and the juxtaposed skirt panels. Examples of such a prior arrangement will be found in U.S. Pat. No. 4,413,719 issued Nov. 8, 1983 to White, and which depicts various configurations of members constructed of resilient plastics and which include yieldable portions biased against the adjacent skirt panels and/or resiliently clamping the tread structure of the steps to retain the members in place.

SUMMARY OF THE INVENTION

By the present invention, an improved arrangement is provided wherein a substantially planar, dimensionally stable side plate is fixedly attached to each side of each stair step and substantially fully overlies the step end surfaces or side walls so as to occupy the gap normally existing between each step side and the adjacent escalator skirt panel. The two side plates for each step are retained in their installed position by means of a pair of tie rods extending the width of the step and which engage with cooperating counterbores formed in the side plates to allow for the acceptance of suitable simple fasteners. In this manner, it will be seen that an interface between the lateral portions of each step is carried by the steps and to provide an outer face of low friction material immediately juxtaposed the stationary skirt panel of the escalator assembly. With the present construction, the installation or replacement of the side plates is a simple, quick procedure resulting in very little down time while providing a most efficient interface between the moving stair steps and stationary skirt panel of an escalator.

Accordingly, one of the objects of the present invention is to provide an improved escalator step side plate including a substantially planar member overlying and enclosing each side of an escalator step with at least a pair of tie rods retaining the side plate affixed to each step so that the normal existing gap between the step and and escalator skirt panel is substantially filled by the side plate.

Another object of the present invention is to provide an improved escalator step side plate including a substantially planar member adapted to mask an end of a step and provided with a pair of integral counterbores receiving tie rods and removable fasteners for retaining the two side plates affixed to a step.

Still another object of the present invention is to provide an improved escalator step side plate including a substantially planar member removably attached to each side of a step and extending downwardly from the tread to the step support bracket and extending horizontally from the step riser edge to the rear edge of the step.

A further object of the present invention is to provide an improved escalator step side plate including a substantially planar, dimensionally stable member enclosing the sides of the step to provide an outer face of low-friction material juxtaposed the skirt panels of an escalator assembly and with a pair of tie rods retaining two such side plates to each step by means of push-type fasteners applied to the ends of the tie rods.

With these and other objects in view which will more readily appear as the nature of the invention is better understood, the invention consists in the novel construction, combination and arrangement of parts hereinafter more fully described, illustrated and claimed.

BRIEF DESCRIPTION OF THE DRAWING

Similar reference characters designate corresponding parts throughout the several figures of the drawing.

DESCRIPTION OF THE PREFERRED EMBODIMENTS

Figure 1:
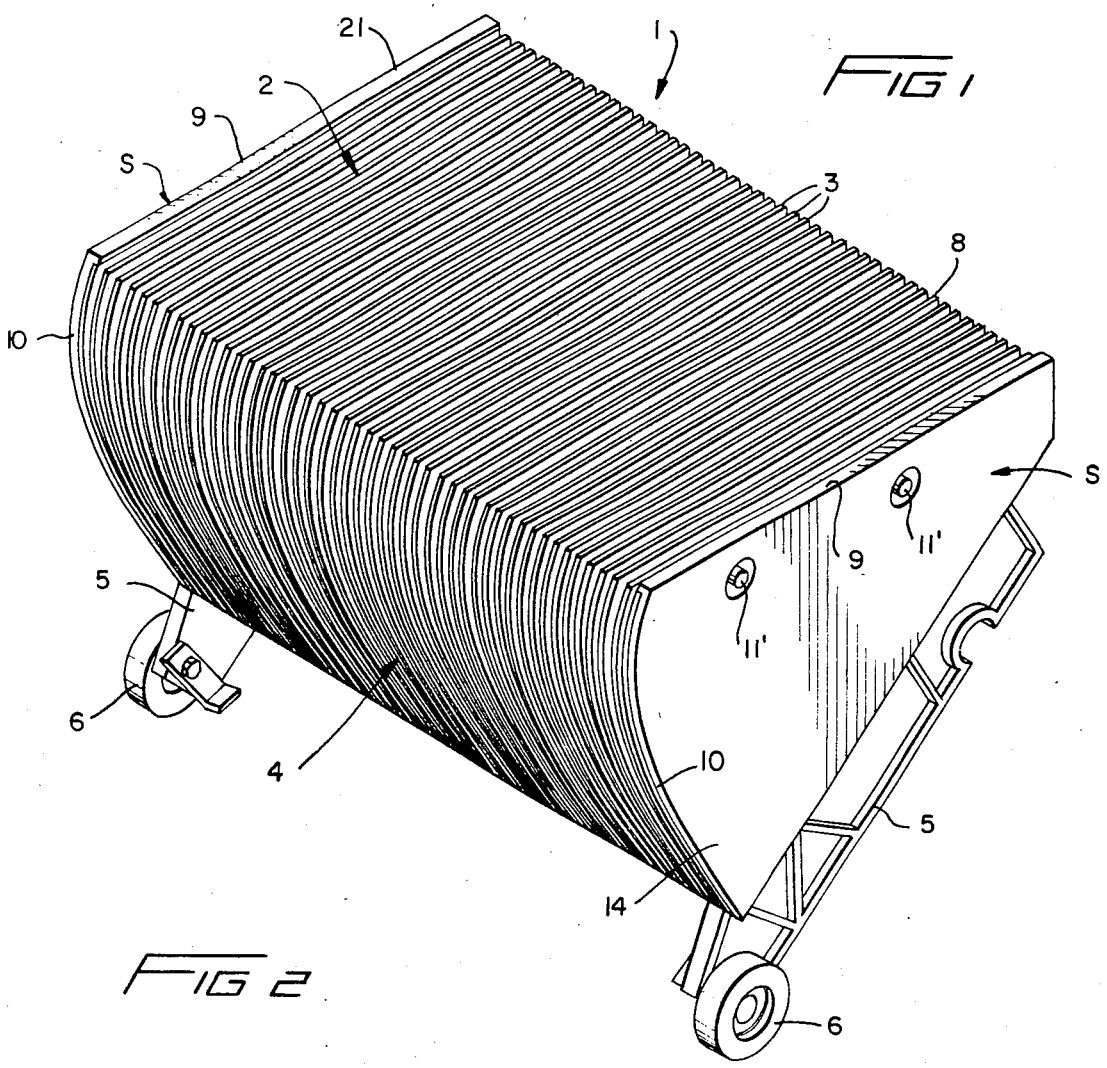
FIG. 1 is a perspective view of an escalator step illustrating the side plate of the invention as installed.

Referring now to the drawing, particularly FIG. 1, the present invention will be seen to relate to an escalator stair step generally designated 1 and which may be of any well known construction basically comprising an uppermost tread 2 including the usual parallel, spaced apart cleats 3 configured according to the safety code requirements. The forward portion of the step 1 is formed with an arcuate riser 4. The bottom of the step is provided with the usual support bracket 5 adapted to mount the step wheel 6. One such support bracket 5 is affixed to the bottom of each step in an inwardly offset manner with respect to each side wall 7 of the step.

The normally open interior area bounded by the step tread, riser, support bracket and rear edge 8, is adapted to be masked or enclosed by the side plate S of the present invention in the area of each step side wall 7. Each side plate is preferably constructed of a constant thickness synthetic plastics material such as the low-friction product available under the trademark "Celcon" and will be understood to provide a dimensionally stable member rather than a resilient, easily deflectable member.

The uppermost portion adjacent the tread edge 9 of each side plate flushly engages the side wall of the step along the length of the tread while the forward riser edge 10 of the side plate flushly engages the step side wall along the end of the riser 4. With this flush engagement of a substantial portion of the periphery of the side plate with the side wall 7 of the step, it will be appreciated that planar stability is assured so long as the side plate is retained in the illustrated position. The above referenced retention is preferably achieved by means of at least two elongated members such as the tie rods 11 adapted to span the normally open space 12 within the interior of each step. The tie rods 11 are formed such that the ends 11'—11' thereof, when positioned as in FIG. 2 of the drawing, will be disposed slightly inwardly of the plane of the outer face 14 of the two side plates S, S of each step. The ends 11'—11' of each tie rod 11 are fully accommodated within respective counterbores 15 formed in the side plates. These counterbores will be seen to include a substantially recessed bottom wall 16 joined to the side plate outer face 14 by means of a circular peripheral wall 17.

Figure 2:
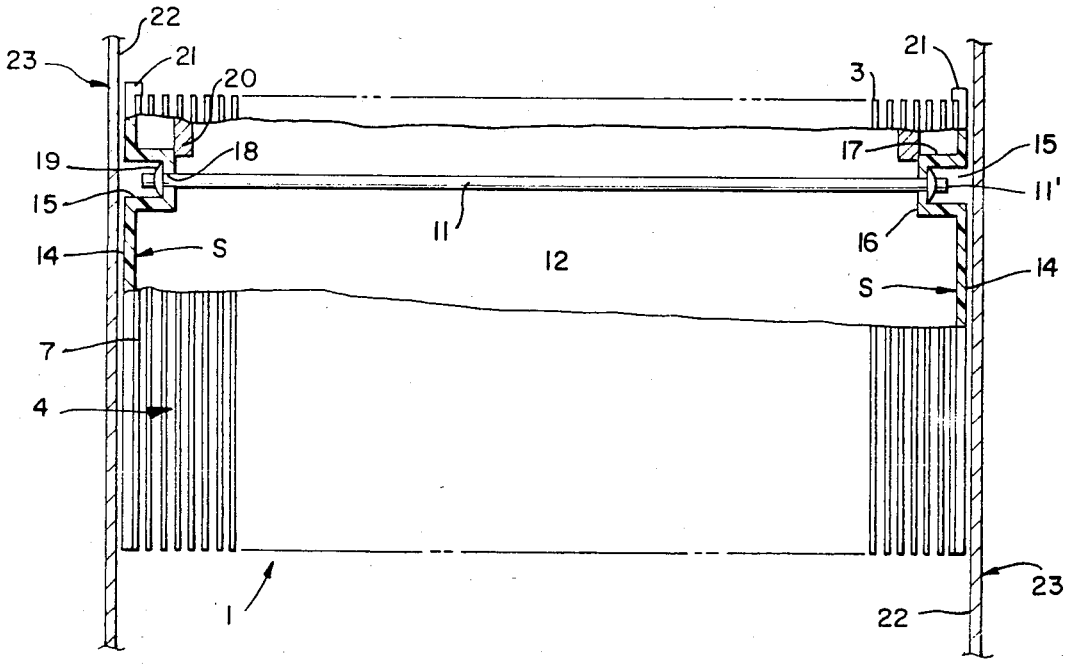
FIG. 2 is a front elevation of the assembly of FIG. 1, positioned between two skirt panels and with portions broken away to illustrate the attachment structure.

The mounting or assembly of the two side plates S-S upon any one step 1 is accomplished simply by placing the side plates flushly against the respective side wall 7 of the step with the two tie rods 11 having their respective ends 11' disposed through apertures 18 formed in the counterbore bottom walls 16. Thereafter, a suitable fastener 19 is affixed to each tie rod end 11' within the confines of the counterbores to fixedly retain the side plates in the assembled position as shown in the drawing. Various types of well known fasteners may be utilized yet a most economical and readily accomplished fixation is achieved by utilizing the simple fastener of the push type and which is marketed commercially under the trademark "PalNut". This type of fastener requires no preparation of the cooperating circular tie rod ends 11' such as threading or the like and is readily attached merely by applying an inward, axial pressure thereto. Stop means, in the form of a shoulder or collar 20 may be included within the open space 12 of each step in the area of the attached side plate counterbores 15 as shown in FIG. 2 of the drawing. In this manner, a positive stop is provided to limit the inward displacement of the counterbore bottom wall 16 and thus preclude the application of excessive inward displacement of the counterbores during application of the fasteners 19 so that deformation of the planar side plate outer face 14 is avoided.

FIG. 2 most clearly illustrates a preferred configuration along the tread edge 9 of the left and right hand side plates S depicted therein. Each side plate will be seen to include an inwardly offset flange or arm 21 overlying at least the outermost cleat 3 of the step tread 2. With this arrangement, the arm 21 provides registry means to insure proper orientation of the side plate against the step side wall 7 prior to installation. Additionally, the innermost portion of this arm 21 may include a downwardly directed extension (not shown) adapted to engage within the outermost slot between the two endmost cleats 3.

With the above construction in mind, it will be appreciated that an improved escalator step side plate is provided which presents a planar outer face adapted to move in a juxtaposed manner along the inner surface 22 of the escalator skirt panels 23, and these side plates S are positively affixed to the respective side walls of the steps by quickly applied, simple means comprising tie rods and push type fasteners cooperating with counterbores formed in the side plates.

Inasmuch as the present invention is subject to many modifications, alterations and changes in details, it is intended that all matter contained in the foregoing description or shown on the accompanying drawing shall be interpreted as illustrative and not in a limiting sense.

I claim:

1. An escalator step having side plates adapted to pass in close proximity to stationary skirt panels, said step having opposite side walls normally spaced inwardly from said skirt panels, said side plates each comprising:

a unitary substantially planar member overlying one said step side wall and having an outer face presenting a low co-efficient of friction surface juxtaposed one said skirt panel, each side plate including a pair of counterbores, disposed away from its corresponding stationary skirt panel, a bottom wall of each said counterbore extending away from its corresponding stationary skirt panel, said bottom wall having an aperture, a pair of tie rods extending between each pair of side plates and having end portions thereon, said end portion of each tie rod extending through its corresponding aperture in said bottom wall and into its corresponding counterbore, push-on fastener means engaging each tie rod end portion and its corresponding bottom wall whereby each side plate is securely fastened against its corresponding side wall, said step including an uppermost cleated tread, and each of said side plates including a top tread edge having an inwardly offset arm overlying said uppermost cleated tread.

* * * * *